US005603263A

United States Patent [19]

Dufour et al.

[11] Patent Number: 5,603,263

[45] Date of Patent: Feb. 18, 1997

[54] SCRAPER BLADE AND INK SCAVENGER FOR PRINTING PRESSES

[75] Inventors: Charles H. Dufour, Durham; David C. Pollock, Somersworth, both of N.H.

[73] Assignees: Heidelberger Druckmaschinen AG, Heidelberg, Germany; Heidelberg Harris, Inc., Dover, N.H.

[21] Appl. No.: 525,105

[22] Filed: Sep. 8, 1995

[51] Int. Cl.[6] ..... B41F 35/00

[52] U.S. Cl. ..... 101/423; 101/167

[58] Field of Search ..... 101/423, 169, 101/167, 157, 154, 155, 153, 425

[56] References Cited

U.S. PATENT DOCUMENTS

| | | | |
|---|---|---|---|
| 3,552,850 | 1/1971 | Royka et al. | 355/299 |
| 3,601,051 | 8/1971 | Gregenheimer et al. | 101/425 |
| 4,211,484 | 7/1980 | Iwai et al. | 355/15 |
| 4,254,709 | 3/1981 | Arnolds | 101/425 |
| 4,311,094 | 1/1982 | Ellison | 101/425 |
| 4,393,775 | 7/1983 | Cappel et al. | 101/155 |
| 4,466,348 | 8/1984 | Buhrer | 101/167 |
| 4,498,760 | 2/1985 | Sugiyama | 355/15 |
| 4,773,327 | 9/1988 | Moetteli | 101/169 |
| 4,782,756 | 11/1988 | Howard | 101/425 |
| 4,922,820 | 5/1990 | Grossmann et al. | 101/425 |
| 5,046,420 | 9/1991 | Sondergeld et al. | 101/350 |
| 5,111,747 | 5/1992 | Kobler et al. | 101/365 |
| 5,205,216 | 4/1993 | Okamura et al. | 101/367 |

FOREIGN PATENT DOCUMENTS

| | | | |
|---|---|---|---|
| 0004558 | 10/1979 | European Pat. Off. . | |
| 159416 | 3/1983 | Germany | 101/114 |
| 241043 | 11/1986 | Germany | 101/425 |
| WO87/06528 | 11/1987 | WIPO . | |

OTHER PUBLICATIONS

"News From Baldwin" by Baldwin Technology Corporation, 7 pages, 1987.

*Primary Examiner*—Edgar S. Burr
*Assistant Examiner*—Anthony H. Nguyen
*Attorney, Agent, or Firm*—Kenyon & Kenyon

[57] ABSTRACT

The present invention relates to a device for removing ink, water and contamination build-up on an ink roller in a printing press. The present invention also relates to a device for scavenging unused ink from an ink roller in a printing press, to allow the return the unused ink to the ink fountain. One embodiment of the invention includes a movable scraper blade having a gap corresponding to the lithographic or printing area of the ink roller. In this embodiment, the blade scrapes ink and/or water off of the ink roller only in the areas adjacent the lithographic or printing area. In another embodiment, a scraper blade is constructed of a series of blade segments, with each blade segment being independently actuatable through an actuator. This embodiment allows the scraping area or areas to be adjusted by simply controlling the appropriate actuators for the blade segments corresponding to the scraping area. The scraped ink can be sent directly back into the ink fountain, can be purified before being directed to the ink fountain, or can be disposed.

22 Claims, 5 Drawing Sheets

SCRAPER BLADE AND INK SCAVENGER FOR PRINTING PRESSES

BACKGROUND OF THE INVENTION

1. Field of the Invention

The present invention relates to a device for removing ink and water build-up on an ink roller in a printing press. The present invention also relates to a device for scavenging unused ink from an ink roller in a printing press, to allow the return the unused ink to the ink fountain.

2. Discussion of the Prior Art

Ink stripping wheels have been used to remove excess ink and/or water build-up from the non-printing areas of an ink roller train. This build-up is caused by the tendency of ink to migrate during printing operations to the ends of the ink roller train and build up at the ends of the rollers. Such build-up can cause pitting of the ink rollers, resulting in permanent damage to the rollers and the deterioration of print quality. Such buildup can also alter lithographic chemistry on the outside edges of the image areas. Ink stripping wheels manufactured by the Baldwin company have been placed adjacent the ink rollers in prior art printing presses to remove such build-up.

Ink stripping wheels include a first roller, generally constructed of an elastomeric material such as rubber, which contacts the ink roller. The first roller removes excess ink from the area of the ink roller which it contacts. A second roller, often constructed of a metallic material such as steel, contacts the first roller and removes ink from the first roller. A blade contacts the second roller and strips ink from the second roller, which stripped ink is dumped into a trough or catch pan below the blade.

Ink stripping wheels have certain disadvantages. First, the stripping wheels are of relatively complicated design with several moving parts, and therefore can be difficult to maintain. Furthermore, these devices require significant maintenance and set-up time and operator interaction during operation. Finally, the moving parts of ink stripping wheels can have high failure rates when the press is operated at over 2000 fpm (feet per minute).

SUMMARY OF THE INVENTION

The present invention relates to ink scraper blade designs for removing excess ink and/or water from non-printing areas of an ink roller. For example, if an image width is significantly narrower than the maximum printable width of the machine, then areas outside the image will be subject to ink buildup and contamination. The present invention also relates to a ink scavenger device which is used in conjunction with an ink scraper blade to return ink removed by the scraper blade to an ink fountain or to a collection tray which leads to a purification system for purifying removed ink.

A first embodiment of the present invention includes a scraper blade which may have a cutaway area of a width slightly greater than the width of the printing or lithographic area of the ink roller. This blade may be mounted on a collection or catch tray pivotally or otherwise movably mounted adjacent the ink roller to be scraped or cleaned. The blade is aligned on the tray such that the gap in the blade is situated over the location of the printing or lithographic area. A mechanism is used to move the tray towards the ink roller, so that the blade contacts the ink roller. This contact causes the blade to scrape ink and/or water from the areas of the roller which are not used for printing on the web, and the scraped ink and/or water is thereafter deposited into the tray. The tray can be directly connected to the ink fountain for that ink roller, to thereby recirculate scraped ink back into the fountain system, or can lead to a purification system, which removes contaminants from the scraped ink and then deposits the purified ink in the ink fountain. The blade can scrape the ink roller for two or three minutes per hour of operation, and can be moved into a scraping position by an automatic or computer-controlled throw-on mechanism.

In another embodiment of the present invention, a segmented ink scraping blade is provided adjacent an ink roller in a printing press. Each segment of the ink scraping blade is connected to an actuation device such as a solenoid, which actuation device is used to cause the associated segment of the blade to contact the ink roller. The segments of the ink scraper blade correspond in width and position to the segments of the ink fountain used with the ink roller. Each individual segment of the blade can be controlled to scrape or not to scrape a particular width of the ink roller, depending on conditions of printing or the width of the web being printed. The scraped ink and/or water can be channelled directly back into the ink fountain, or could be directed through a purification system before being directed to the fountain. The scraper blade segments in this embodiment are desirably configured to be sloped from the edges towards the middle of the segment, to thereby ensure that scraped ink is directed towards the center of the segment and into the appropriate fountain.

BRIEF DESCRIPTION OF THE DRAWINGS

The foregoing and other features of the present invention will become apparent to those skilled in the art, upon reading the following description of preferred embodiments of the invention, in view of the accompanying drawings, wherein.

DESCRIPTION OF PREFERRED EMBODIMENTS

Figure 1:
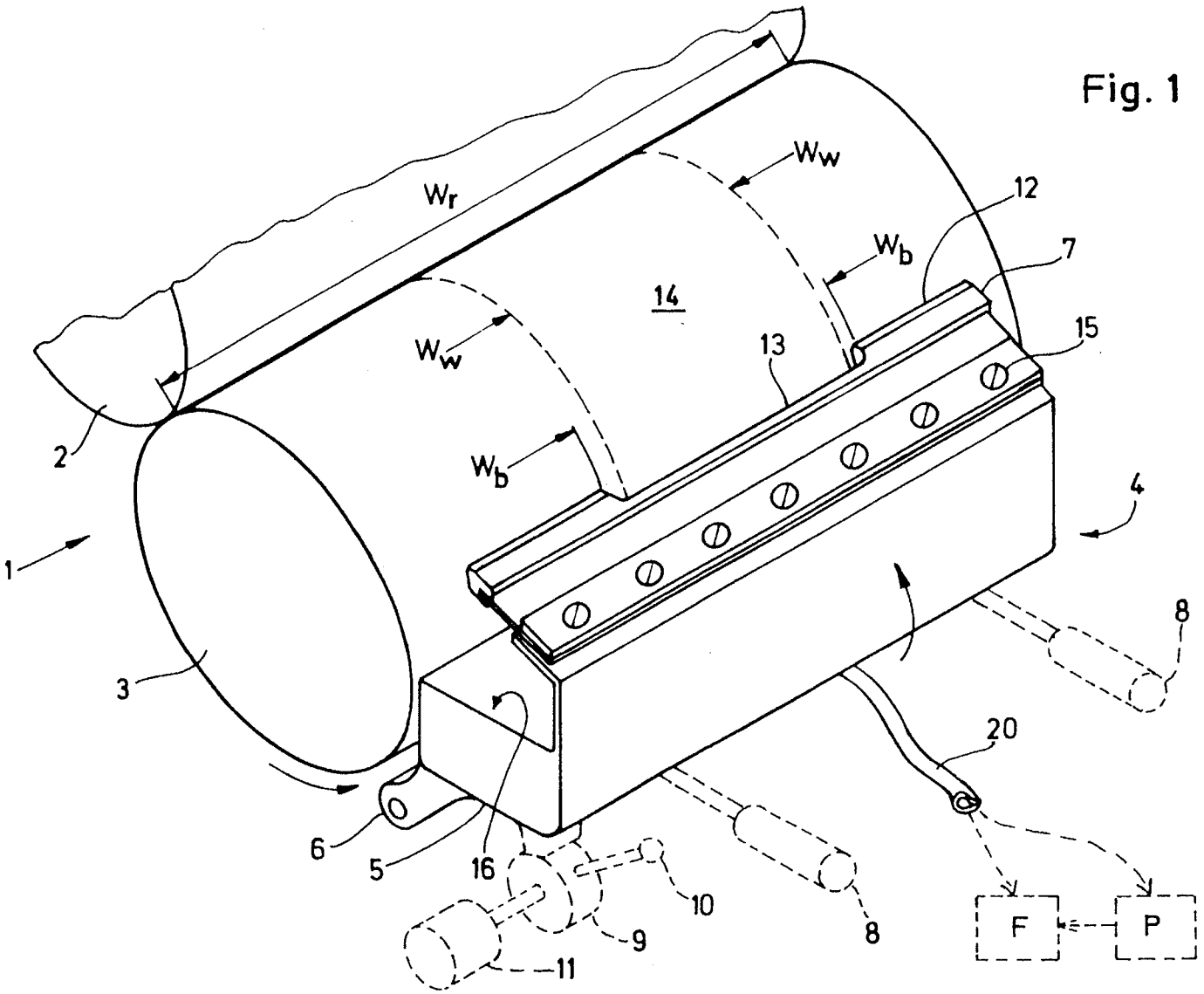
FIG. 1 is a perspective view of a first embodiment of the present invention.

FIG. 1 shows a first embodiment of the present invention, used in a printing press unit 1 including ink rollers 2, 3. Mounted adjacent to ink roller 3 is an ink scraper and scavenger apparatus 4 for removing ink and water build-up on ink roller 3. Ink scraper and scavenger apparatus 4 includes a catch tray 5 which is pivotally mounted by a pivot 6 so as to rotate an ink washup or scraper blade 7 mounted on the catch tray 5 toward and away from ink roller 3. A variety of mechanisms can be used to move ink washup or scraper blade 7 toward and away from ink roller 3, including air or hydraulic cylinders 8 or a cam mechanism 9 actuated either manually via a lever 10 or automatically via a motor 11. Although ink roller 3 is shown in FIGS. 1–7 being scraped by ink washup or scraper blade 7, any ink roller in printing press unit 1 could be scraped by ink washup or scraper blade 7.

Ink washup or scraper blade 7 includes a resilient portion 12 constructed of an elastomeric or resilient material. Resilient portion 12 includes a cut-out section 13 having a width $W_b$. The width $W_b$ is slightly greater than the width $W_w$ of printng or lithographic area 14 (indicated in dashed lines) on ink roller 3, corresponding generally to the width of the web which is printed. Ink washup or scraper blade 7 is connected to catch tray 5 through any conventional securement device or devices 15, such as screws or bolts. Catch tray 5 includes a catch basin 16 located generally below the ink washup or scraper blade 7. Catch basin 16 receives ink and/or water which is scraped off of ink roller 3 by ink washup or scraper blade 7 when ink washup or scraper blade 7 is in contact with ink roller 3.

Figure 2:
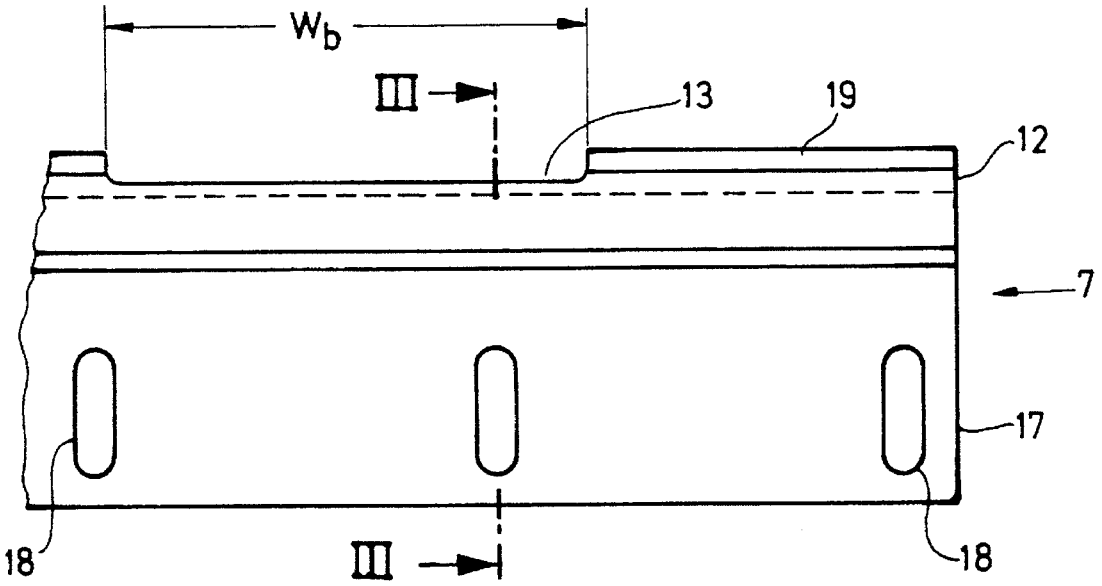
FIG. 2 is a top view of a ink washup or scraper blade of the embodiment of FIG. 1.
Figure 3:
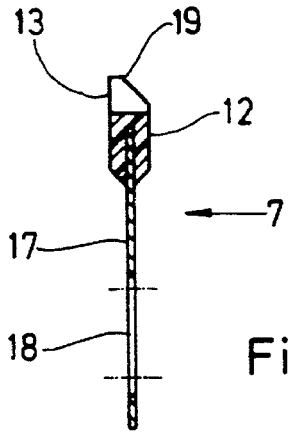
FIG. 3 is a cross-sectional view through line II—II of the ink washup or scraper blade of FIG. 2.

FIGS. 2 and 3 show the particular features of one embodiment of a ink washup or scraper blade 7 which may be used with the embodiment of FIG. 1. Resilient portion 12 is constructed of rubber or any other elastomeric material, and is bonded onto a rigid portion 17. Rigid portion 17 includes a series of openings 18, through which securement devices 15 may be passed to secure ink washup or scraper blade 7 to catch tray 5. Resilient portion 12 can include a taper 19 near the tip of resilient portion 12 which contacts the ink roller 3. Cut-out section 13 is cut out of the part of resilient portion 12 outside of rigid portion 17.

In operation of the device of FIG. 1, ink roller 3 is rotated in the direction R during a printing process. Ink is transferred, via conventional fountain devices and appropriate intermediate rollers, to a printing or lithographic area 14 on ink roller 3. If the width of the web being printed on by printing press unit 1 is narrower than the width $W_r$ of the ink roller 3, the width $W_w$, of printing or lithographic area 14 will not be as wide as width $W_r$. During operation of the printing press unit 1 with a web which is narrower than the width $W_r$, ink and/or water will tend to migrate to the areas immediately adjacent printing or lithographic area 14. Such accumulation can cause pitting of the ink roller 3, resulting in permanent damage to the rollers and deterioration of print quality. Therefore, ink washup or scraper blade 7 is periodically moved so as to contact ink roller 3, to thereby remove accumulation of ink and/or water from the areas of the ink roller 3 adjacent the printing or lithographic area 14. Contact of ink washup or scraper blade 7 with ink roller is accomplished by actuating an actuation device, e.g., air or hydraulic pistons 8, lever 10 and cam 9, or motor 11 and cam 9, to thereby pivot catch tray 5 and ink washup or scraper blade 7 towards ink roller 3 until resilient portion 12 contacts ink roller 3.

Continued rotation of ink roller 3 in the direction R while ink washup or scraper blade 7 contacts ink roller 3 causes ink and/or water to be scraped off of ink roller 3. Because of cut-out section 13, which is wider than, and aligned with, printing or lithographic area 14, ink is not scraped off of printing or lithographic area 14. Ink and/or water which is scraped from ink roller 3 flows into, and is captured by, catch basin 16 of catch tray 5. The material caught in catch basin 16 can be directed, by suitable flow lines 20, directly back to an ink fountain F for printing press unit 1, can be passed through a purification unit P for removing impurities from the ink and then directed to ink fountain F, or can be disposed of. For most satisfactory results, the ink washup or scraper blade 7 should be "thrown on," i.e., contact ink roller 3, for approximately two to three minutes for every hour of operation of the printing press unit 1.

Figure 4:
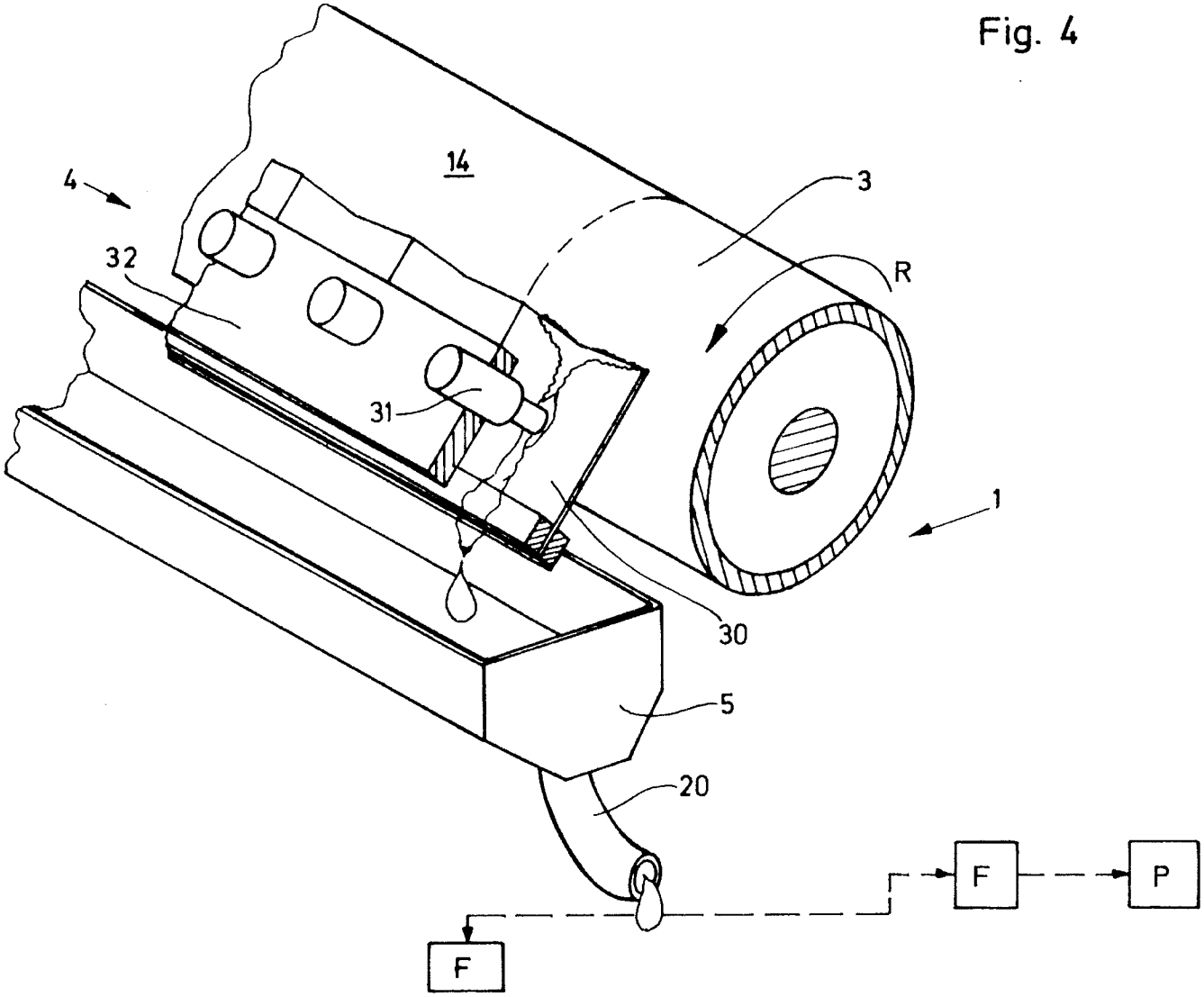
FIG. 4 is a perspective view of a second embodiment of the present invention.

FIG. 4 shows a second embodiment of the present invention. The embodiment of FIG. 4 includes a scraper blade 7 which is divided into several separate segments 30. Each segment 30 is mounted on catch tray 5 and has mounted above it an actuator 31, such as a solenoid, air piston or motorized screw. Each actuator 31 is used to move a corresponding segment 30 toward and away from ink roller 3. Actuators 31 are all mounted in a mounting plate 32, and each actuator 31 is connected to a controller for selectively controlling the actuation of the actuators. The controller can be in the form of a microprocessor, particularly the microprocessor used in the processing unit for the printing press unit 1. Segments 30 are each made of a flexible or resilient material, such as an elastomer or metal. Because the actuators 31 control the movement of the segments 30 against the ink roller 3, the catch tray 5 can be non-movably mounted relative to the ink roller 3.

Figure 6:
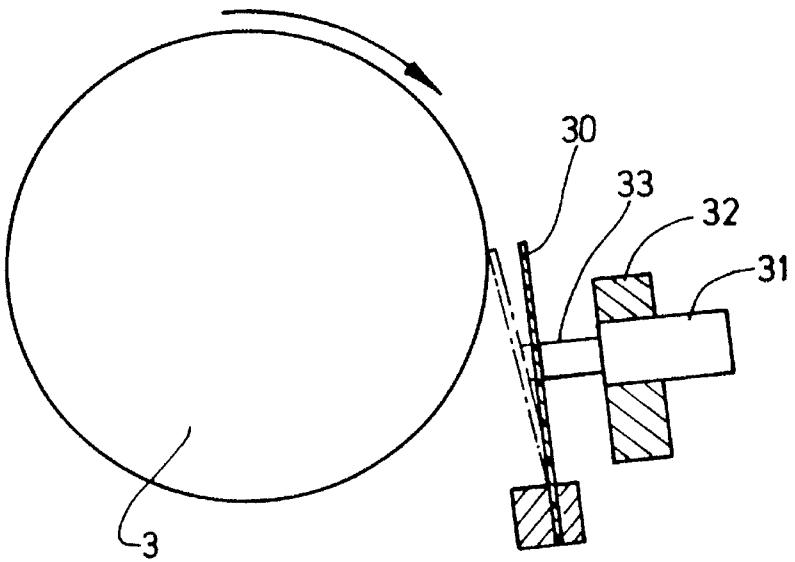
FIG. 6 is a cross-sectional view of the scraper blade of FIG. 5.
Figure 5:
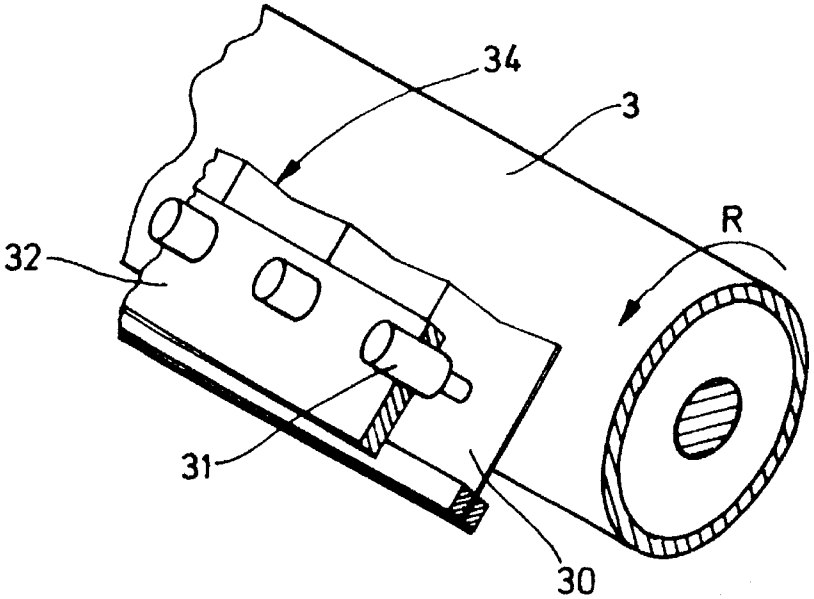
FIG. 5 is a perspective of a scraper blade of the embodiment of FIG. 4.

FIGS. 5 and 6 show the particular features of one embodiment of a scraper blade which may be used with the embodiment of FIG. 4. Scraper blade includes a series of segments 30, each segment being made of a flexible or resilient material. Actuators 31 are mounted in mounting plate 32, mounting plate 32 being fixed to catch tray 5, and have an actuating rod 33 contacting a segment 30. As shown in FIG. 6, in a non-actuated position of actuator 31, the segments remain in an at-rest position away from the ink roller 3. In an actuated position of actuator 31, shown in dashed lines in FIG. 6, the tip of segment 30 contacts the circumference of ink roller 3, to thereby allow scraping of ink and/or water from ink roller 3.

Segments 30 preferably have a V-shaped notch 34 at the tip which contacts ink roller 3. It has been found that such a notch 34 ensures that ink and/or water scraped from the ink roller 3 rolls down the center of the segment 30. Without the notch 34, it is possible for scraped ink and/or water to spray off the edges of the segment and into the roller train—an undesirable result.

In operation of the device of FIG. 4, ink roller 3 is rotated in the direction R during a printing process. Ink is transferred, via conventional fountain devices and appropriate intermediate rollers, to a printing or lithographic area 14 on ink roller 3. If the width of the web being printed on by printing press unit 1 is narrower than the width of the ink roller 3 or there are blank areas of the printing or lithographic area 14 where no ink is transferred, the segments 30 will be extended by actuating actuators 31 so that the segments 30 contact the ink roller 3 to scrape ink and/or water off of a corresponding segment of the ink roller 3.

Continued rotation of ink roller 3 in the direction R while segments 30 contact ink roller 3 causes ink and/or water to be scraped off of ink roller 3. In those segments of the ink roller 3 which correspond to non-actuated segments 30, ink is not scraped off of ink roller 3. In the embodiment of FIG. 4, ink and/or water which is scraped from ink roller 3 flows into, and is captured by, catch tray 5. The material caught in catch tray 5 can be directed, by suitable flow lines 20, directly back to an ink fountain F for printing press unit 1, or can be passed through a purification unit P for removing impurities from the ink and then directed to the ink fountain F, or can be disposed of.

Figure 7:
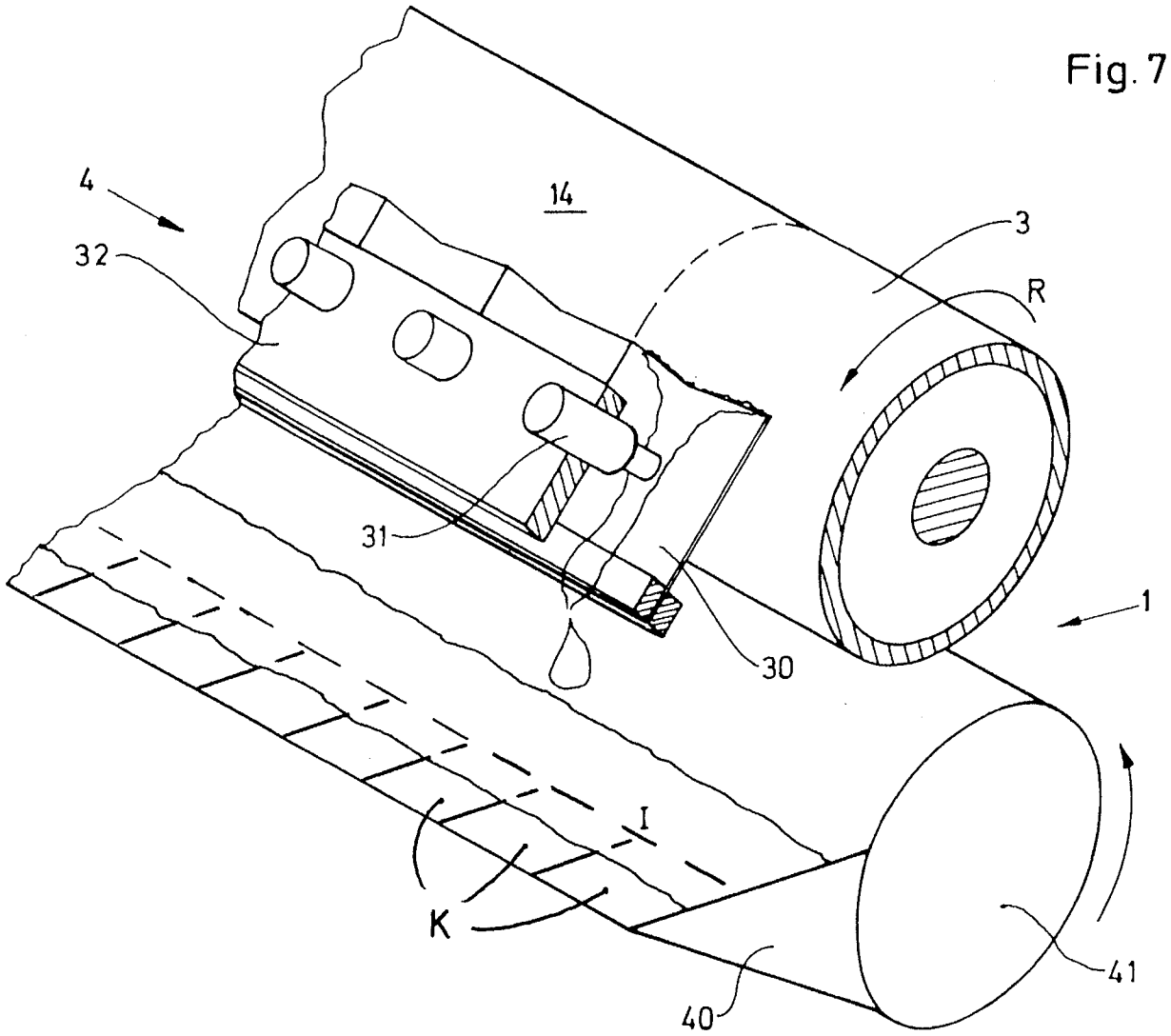
FIG. 7 is a perspective view of a third embodiment of the present invention.

FIG. 7 shows an alternative embodiment of the device of FIG. 4. In the embodiment of FIG. 7, the scavenger apparatus 4 is mounted directly above the ink fountain 40 for ink roller 3. Ink fountain 40, as is known in the art, includes a series of ink keys k which are movable relative to fountain roller 41 to thereby control the amount of ink I from ink fountain 40 to be transferred to the segment of fountain roller 41 corresponding to a particular ink key k. In the embodiment of FIG. 7, the width and location of a segment 30 corresponds to the width and location of an ink key k in ink fountain 40. Therefore, each segment 30 controls the removal or non removal of ink corresponding to an area on ink roller 3 controlled by a particular ink key k. When an ink key k is in the closed position—i.e., where ink flow from the ink fountain 40 to the fountain roller 41 is shut off by that ink key—the corresponding segment 30 will be actuated to scrape ink and/or water off of the portion of the ink roller 3 controlled by the ink key k. This control can be accomplished in the processor unit of the printing press unit 1, by detecting an electrical "zero" signal sent to a particular ink key k and sending a signal to actuate the solenoid 31 for the particular segment 30 above that ink key k. Because of the location of the scavenger apparatus 4 directly above the ink fountain 40, ink scraped off the ink roller 3 will pass directly back into ink fountain 40. During blanket or roller washes, it may be desirable to automatically deactivate all of the segments 30 so that segments 30 disengage from ink roller 3. This operation is easily accomplished by sending a deactivation signal to all actuators 31 when a blanket or roller wash signal is sent to the printing press unit 1 processing unit.

The apparatuses of FIGS. 4 and 7 can have segments 30 which are automatically actuated to engage ink roller 3 when a corresponding ink key is in a closed position so that ink is not transferred to ink roller 3 from that key. Accordingly, the segment 30 corresponding to that key ensures that any ink that migrates to the portion of the roller 3 corresponding to the key and the segment 30 will be scraped of the roller 3. This can be accomplished by any known signal processing equipment, which detects a signal that a particular ink key is closed and sends a signal to the corresponding segment 30 to actuate the appropriate solenoid 31 to cause that segment 30 to contact ink roller 3. Furthermore, as described above, the segments 30 may also be automatically engaged or disengaged from ink roller 3 in response to certain other conditions, i.e., blanket wash in progress. In addition, an operator may, through visual or automatic detection, set segments 30 to continuously engage ink roller 3 in those areas of ink roller 3 where no ink impressions are made, i.e., where there is no printing image.

It is to be understood that the embodiment of FIG. 1 is designed to be easily replaceable, both for maintenance purposes and for the reason that ink washup or scraper blades 7 with different size cut-out section widths $W_b$ are needed for different size lithographic or printing area 14 widths $W_w$. The segments 30 of the embodiments of FIGS. 4 and 7 are also easily replaceable when any segment 30 becomes worn. The embodiments of FIGS. 4 and 7 are easily adaptable to different size lithographic or printing areas 14, as individual segments 30 can be actuated or not actuated to conform to the width $W_w$, of a particular lithographic or printing area 14. The adjustment of the embodiment of FIGS. 4 and 7 can be accomplished by an operator simply by inputting information into the printing press unit 1 processing unit, which information in converted to signals for actuating or not actuating actuators 31.

The present invention contemplates a number of different variations on the above-described preferred embodiments. It is to be understood that the above description is only of one preferred embodiment, and the scope of the invention is to be measured by the claims below.

We claim:

1. An apparatus for removing excess fluid material from an ink roller in a printing press unit, the ink roller comprising a printing area, the apparatus comprising:

an ink scraper blade, the ink scraper blade comprising at least one portion which does not contact the ink roller, the at least one portion which does not contact the ink roller being aligned with and having a width slightly greater than a width of the printing area, the scraper blade further comprising at least one portion which does contact the ink roller;

at least one actuator for moving the at least one portion which does contact the ink roller into engagement with the ink roller; and a receptacle for receiving fluid material scraped from the ink roller by contact between the ink roller and the at least one portion which does contact the ink roller.

2. The apparatus of claim 1, wherein:

the ink scraper blade comprises a resilient material.

3. The apparatus of claim 2, wherein:

the ink scraper blade comprises an elastomeric material.

4. The apparatus of claim 1, wherein:

the ink scraper blade comprises an elongated resilient portion, the elongated resilient portion comprising a gap.

5. The apparatus of claim 1, further comprising:

a catch tray, the ink scraper blade being mounted on the catch tray.

6. The apparatus of claim 5, wherein:

the ink scraper blade comprises an elongated resilient portion, the elongated resilient portion comprising a gap.

7. The apparatus of claim 6, wherein:

the at least one actuator is mounted to move the catch tray towards the ink roller, movement of the catch tray towards the ink roller causing contact between the ink roller and the at least one portion which does contact the ink roller.

8. The apparatus of claim 5, wherein:

the ink scraper blade comprises a resilient portion for contacting the ink roller, and a rigid portion for mounting the ink scraper blade to the catch tray.

9. The apparatus of claim 5, wherein:

the catch tray comprises a catch basin.

10. The apparatus of claim 9, wherein:

the catch basin is connected to a purification unit.

11. The apparatus of claim 10, wherein:

the catch basin is connected to an ink fountain for the ink roller.

12. The apparatus of claim 6, wherein:

the at least one actuator comprises a piston.

13. The apparatus of claim 6, wherein:

the at least one actuator comprises a cam.

14. The apparatus of claim 6, wherein:

the catch tray is pivotally mounted.

15. An apparatus for removing excess fluid material from an ink roller in a printing press unit, comprising:

an ink scraper blade, the ink scraper blade comprising a plurality of segments;

a plurality of actuators, each actuator for moving one of the segments into and out of engagement with the ink roller; and a receptacle for receiving fluid material scraped from the ink roller by contact between the ink roller and the at least one portion which does contact the ink roller.

16. The apparatus of claim 15, wherein:

the segments comprise a V-shaped notch at one end.

17. The apparatus of claim 15, further comprising:

a catch tray, the ink scraper blade being mounted on the catch tray.

18. The apparatus of claim 17, wherein:

the catch tray comprises a catch basin.

19. The apparatus of claim 15, further comprising:

an ink fountain comprising a plurality of ink keys;

the ink scraper blade being mounted above said ink fountain, the segments corresponding in width and location to the ink keys.

20. The apparatus of claim 15, wherein:

the actuators are automatically actuated to place the segments into engagement with the ink roller when ink keys corresponding to the segments are closed.

21. The apparatus of claim 15, wherein:

all of the actuators are automatically actuated to place all of the segments out of engagement with the ink roller during a blanket wash process.

22. The apparatus of claim 15, wherein:

the actuators are automatically actuated to place the segments into engagement with the ink roller when areas of the ink roller corresponding to the segments have no ink impressions.

* * * * *